US006401945B1

(12) United States Patent
Gawel

(10) Patent No.: US 6,401,945 B1
(45) Date of Patent: Jun. 11, 2002

(54) SHELVING UNIT

(76) Inventor: Theodore E. Gawel, 5215 88th St. E., Bradenton, FL (US) 34202-3715

( * ) Notice: Subject to any disclaimer, the term of this patent is extended or adjusted under 35 U.S.C. 154(b) by 0 days.

(21) Appl. No.: 09/566,115

(22) Filed: May 5, 2000

Related U.S. Application Data

(60) Provisional application No. 60/133,158, filed on May 7, 1999.

(51) Int. Cl.[7] ..... A47F 5/08

(52) U.S. Cl. ..... 211/183; 211/153; 211/90.01; 108/90

(58) Field of Search ..... 211/183, 181.1, 211/90.03, 153, 135, 90.01, 134; 108/90, 56.3, 57.17; 248/250; D6/490, 481, 555, 572, 329, 461, 569, 405, 570, 485, 403, 509, 574, 765, 458

(56) References Cited

U.S. PATENT DOCUMENTS

| | | | | | |
|---|---|---|---|---|---|
| 1,596,296 | A | * | 8/1926 | Oberdorfer | 108/90 |
| 3,241,334 | A | * | 3/1966 | Amore | 62/382 |
| 3,513,786 | A | * | 5/1970 | Kellogg | 108/64 |
| 3,678,868 | A | * | 7/1972 | Hirota | 108/57.17 |
| 3,998,069 | A | * | 12/1976 | Kronenberger et al. | 211/183 X |
| D249,312 | S | * | 9/1978 | Taber | D6/484 |
| 4,567,701 | A | * | 2/1986 | Biggs et al. | 52/233 |
| 4,709,642 | A | * | 12/1987 | Briosi | 108/111 |
| 4,738,204 | A | * | 4/1988 | Hammarberg | 108/57.31 |
| 4,768,686 | A | * | 9/1988 | Storti | 223/86 |
| 4,846,077 | A | * | 7/1989 | Win | 108/57.25 |
| 4,890,746 | A | | 1/1990 | Trulaske, Sr. | |
| D310,459 | S | * | 9/1990 | Gipe | D6/556 |
| 5,090,398 | A | * | 2/1992 | Raymer et al. | 108/64 |
| D333,645 | S | | 3/1993 | Tyler | |
| 5,228,581 | A | | 7/1993 | Palladino et al. | |
| 5,282,595 | A | * | 2/1994 | Conforti | 248/214 |
| D354,864 | S | | 1/1995 | Kokenge et al. | |
| 5,538,147 | A | | 7/1996 | Fucci | |
| 5,597,077 | A | | 1/1997 | Hartmann | |
| 5,664,513 | A | * | 9/1997 | Echelbarger | 114/45 |
| 5,697,302 | A | * | 12/1997 | Putnam | 108/90 |
| D391,421 | S | * | 3/1998 | Steelman | D6/479 |
| 5,810,179 | A | | 9/1998 | Kleiman | |
| D400,038 | S | * | 10/1998 | Herman et al. | D6/574 |
| D412,079 | S | | 7/1999 | Wegman | |

OTHER PUBLICATIONS

Yield House, Catalog, p. 27, Fall 1997.*

* cited by examiner

*Primary Examiner*—Daniel P. Stodola
*Assistant Examiner*—Erica B. Harris
(74) *Attorney, Agent, or Firm*—Philip J. Pollick

(57) ABSTRACT

A shelving unit for a wire rack is formed from an essentially flat elongated shelf member with at least one cleat attached transverse to the underside of the shelf member and extending downward between a pair of adjacent support wires of the wire rack, preferably in a frictional fit to prevent movement of the shelf in a sideways, forward and back, or twisting manner. Additional cleats, spaced apart from each other and extending downward between other pairs of support wires are typically used. The shelf unit member may be formed from slats that are spaced apart from each other or in contact with each other in a butt, lap, tongue and grove or other joint arrangement. Each cleat may be formed as two or more spaced apart cleat sections that, when properly sized and positioned, accept differently positioned cental support rods from major wire-rack manufacturers which serve as a stop to prevent the shelf unit from falling from the wire rack. Preferably, the cleats and shelf member are made from aromatic cedar to give an air, linen and clothing freshening aroma and insect repelling qualities.

4 Claims, 4 Drawing Sheets

SHELVING UNIT

CROSS REFERENCE TO RELATED APPLICATION

This application claims the benefit of U.S. Provisional Application 60/133,158 filed on May 7, 1999 all of which is incorporated by reference as if completely written herein.

BACKGROUND OF THE INVENTION

1. Field of the Invention

This invention pertains to shelving and more particularly to a shelving unit adapted for use with a wire rack.

2. Background of the Invention

Wire racks have been a staple of the building industry as a quick and easy shelving device and are fully exemplified in several US patents such as U.S. Pat. Nos. 4,316,593; 4,781,349; 5,148,928; and 5,346,077. Such racks have been found to have many disadvantages including the fact that because they are formed from spaced-apart wires, they leave imprints on items placed on the rack in contact with the wires. This can be especially severe when the protective coating on the wires is broken and leaves metal or rust stains on stored clothing and other valuable items. Although paper, cardboard, and heavier flexible vinyl, plastic, or rubber materials can be laid on the wire racks to prevent direct contact of stored items with the support wires, this presents a further problem in that such materials may pull forward when a selected item is removed from the rack causing the contents of the entire shelf to fall from the shelf doing possible damage to the stored items and causing possible injury to the nearby individual.

U.S. Pat. No. 5,697,302 (Putnam) addresses the slippage problem by using a sufficiently flexible and soft material so that the wire cross members made a slight impression or indentation into the covering material. The inventor realizes that this is insufficient to prevent slippage and thus further treats the underside of his pad with an adhesive that adheres to the vinyl coating used with wire shelving. Unfortunately the use of tackifying (sticky or adhesive-like) agents on the bottom of the pad bring with it additional problems. First much of the tackifying agent will be exposed to the air in the area between the wire cross members and will tend to attract and accumulate dirt and dust. Second, the tackifying agent may eventually dry and produce a bond between the soft pad and the cross-member wires. Since the pad is of soft material, it is likely to tear and pull away from the wires leaving unsightly chunks of material attached to the wire-cross members when one attempts to move or remove the liner. Even if the pad material does not become glued to the cross-members wires, some of the adhesive is likely to remain behind leaving the wires sticky and gummy. Where the wires are sticky and gummy or have pieces of pad attached or both, they become virtually impossible to conveniently clean and restore to their original state.

Both U.S. Pat. Nos. 5,697,302 and 5,538,147 address the slippage problem but in a less than satisfactory manner. The 5,538,147 patent uses a thin flexible sheet material supplied in rolls. The sheet material is formed with perforations to separate individual covers from a roll. Each cover is formed with extending tabs having notches that interlock with the wire, cross members to prevent slippage. As noted in the 5,697,302 patent, such covers simply do not provide adequate support on a wire-frame shelf. They are easily damaged and require frequent replacement. It is further noted that because the material is thin and flexible, the tabs are unlikely to have much effect in preventing movement of the covers. If the cover is produced from thicker material, manipulation of the tabs becomes a problem. Less flexible material is likely to crack and break when the tab is bent into position. Further the manipulation of the tab between the wire cross members and their subsequent movement to the interlock position is likely to be quite difficult for thicker cover materials.

U.S. Pat. No. 5,597,077 uses a spring clip that engages a front rod of the wire rack and also engages a clear plastic panel. The spring clip allows rotating about the front wire rack rod cross member. This presents the problem of wear and possible chipping of the paint on the wire rack member during installation and use of the panel. In another embodiment, the rotating clip is eliminated in favor of a downward extending tab. Such a tab still allows for some movement since the tab will only stop the panel assembly from coming forward beyond the rod cross member. As the inventor recognizes, the panel can slide to a limited degree and it is possible to dislodge the clips from the panel presumably in either embodiment.

Generally it is noted that when any of the prior art devices must be attached to the wire rack, it may be inconvenient to manipulate the attaching devices on lower shelving, especially securing devices that must be manipulated from below the wire rack. This can be especially troublesome for individuals with arthritic and other joint conditions who cannot stoop or bend to reach below lower level racks or manipulate the intricate securing devices. Finally it is noted that none of the prior art devices have the ability to freshen the air, linens and clothing and/or repel moths and other insects.

To overcome these problems, it is an object of the current invention to provide shelving for a wire rack that easily locks into place with a minimum of manipulation.

It is an object of the current invention to prevent unsightly indentations (grid marks) on items such as clothing stored on wire racks.

It is an object of the current invention to prevent rust, mildew, paint chips and other hard to remove materials from staining materials placed on the wire racks.

It is an object of the current invention to prevent slippage of covering materials placed on the wire rack and resulting damage to stored items or nearby individuals when the contents of the entire shelf fall when items are removed from prior art covering materials.

It is a further object of this invention to provide an air freshener.

It is a further object of this invention to provide a moth repellant without the use of toxic chemicals.

It is another object of the present invention to provide a shelf cover that is simple in construction.

It is an object of the present invention to provide a shelving cover that is inexpensive to manufacture.

It is an object of the present invention to provide a wire rack cover or liner that has a long life of useful service.

It is a further object of the present invention to provide a cover or liner that is easy to maintain.

It is another object of the present invention to provide a cover or liner that fits and interlocks with most wire rack shelving assemblies.

SUMMARY OF THE INVENTION

To solve these problems and meet these objects, the present invention of a shelf unit has a substantially flat elongated shelf member that is placed in contact with and positioned so that the lengthwise dimension of the shelf member is substantially transverse to the spaced-apart support wires of a wire shelf rack. The invention features one or more cleats that are attached to the under surface of the elongated shelf member and are oriented in a transverse direction to the lengthwise dimension of the shelf member, that is, oriented so that the lengthwise dimension of the cleat is parallel to the support wires when the lengthwise dimension of the shelf member is positioned at right angles to the support wires. The cleats have a width to fit between a pair of two adjacent spaced-apart support wires of the shelf rack. The cleats extend downward between the spaced-apart support wires until the shelf member contacts the top of the support wires. The cleats contact one or more of the wire rack support rods which serve as a stop and prevent the shelf unit from coming sufficiently forward to fall from the wire shelf rack. The cleats also prevent side ways motion of the shelf unit and because of their length also prevent twisting rotational motion of the shelf unit.

When more than one cleat is used, as is typically the case, the cleats are spaced apart from each other so that they align with and project downward through pairs of adjacent rack support wires. This has the further advantage of minimizing any twisting motion of the shelf unit. The cleats can be formed as two or more spaced apart cleat sections to accommodate a center support rod between the intervening space between two cleat sections. This has the advantage of locking the shelf unit to the support rod so that it cannot move in either a forward or rearward direction. Preferably the invention features cleats that engage a pair of adjacent support wires in a force fit so as to take advantage of the frictional engagement between the support wires and the sides of the cleat. This frictional engagement has the advantage of preventing forward and backward movement of the shelf unit and virtually eliminates any twisting or sideways motion of the shelf unit. The use of additional spaced apart cleats along the length of the shelf member that also engage adjacent support wires further increases the frictional forces available to prevent movement of the shelf unit with respect to the wire rack. Even if the frictional feature of the invention should fail, the shelf unit is still prevented from falling from the wire rack by one of more of the support rods that act as a stop to forward movement when they engage the ends of the cleats.

The essentially flat elongated shelf member of the shelf unit can be formed in a wide variety of ways. It can be formed from a single piece of material or from two or more slats in spaced apart or contacting relation. When slats are used to form the flat elongated member, the cleats not only project downward between the rack support wires to prevent lateral, forward and reverse, and twisting movement, they also maintain the slats in fixed relation with each other, that is, in spaced apart relation or in contact with each other. When the slats are in a contacting relation, various joint configurations such as butt, ship-lap, and tongue and groove slat joint edges may be used to afford good contact of the mating slat sides.

The cleats and flat elongated member can be formed from a wide variety of materials including, for example, wood, metal, plastic, laminates, veneers, particle board, corrugated board. The cleats and flat elongated member can be formed from separate pieces or as an integrated piece such as by molding or pressing. When the cleats and elongated member are separate pieces they are joined with any suitable fastener including staples, brads, nails, screws, adhesives, glues, dovetail joints and combinations thereof. At least a portion of the cleats or cleat sections and elongated shelf members or slats can be treated with air freshening and/or insect repelling compositions and materials. Preferably at least a portion of the shelf member or cleats are formed from aromatic cedar wood to provide both an air freshening aroma for clothing and linens while providing insect repelling capabilities.

The foregoing and other objects, features and advantages of the invention will become apparent from the following disclosure in which one or more preferred embodiments of the invention are described in detail and illustrated in the accompanying drawings. It is contemplated that variations in procedures, structural features and arrangement of parts may appear to a person skilled in the art without departing from the scope of or sacrificing any of the advantages of the invention.

Figure 1:
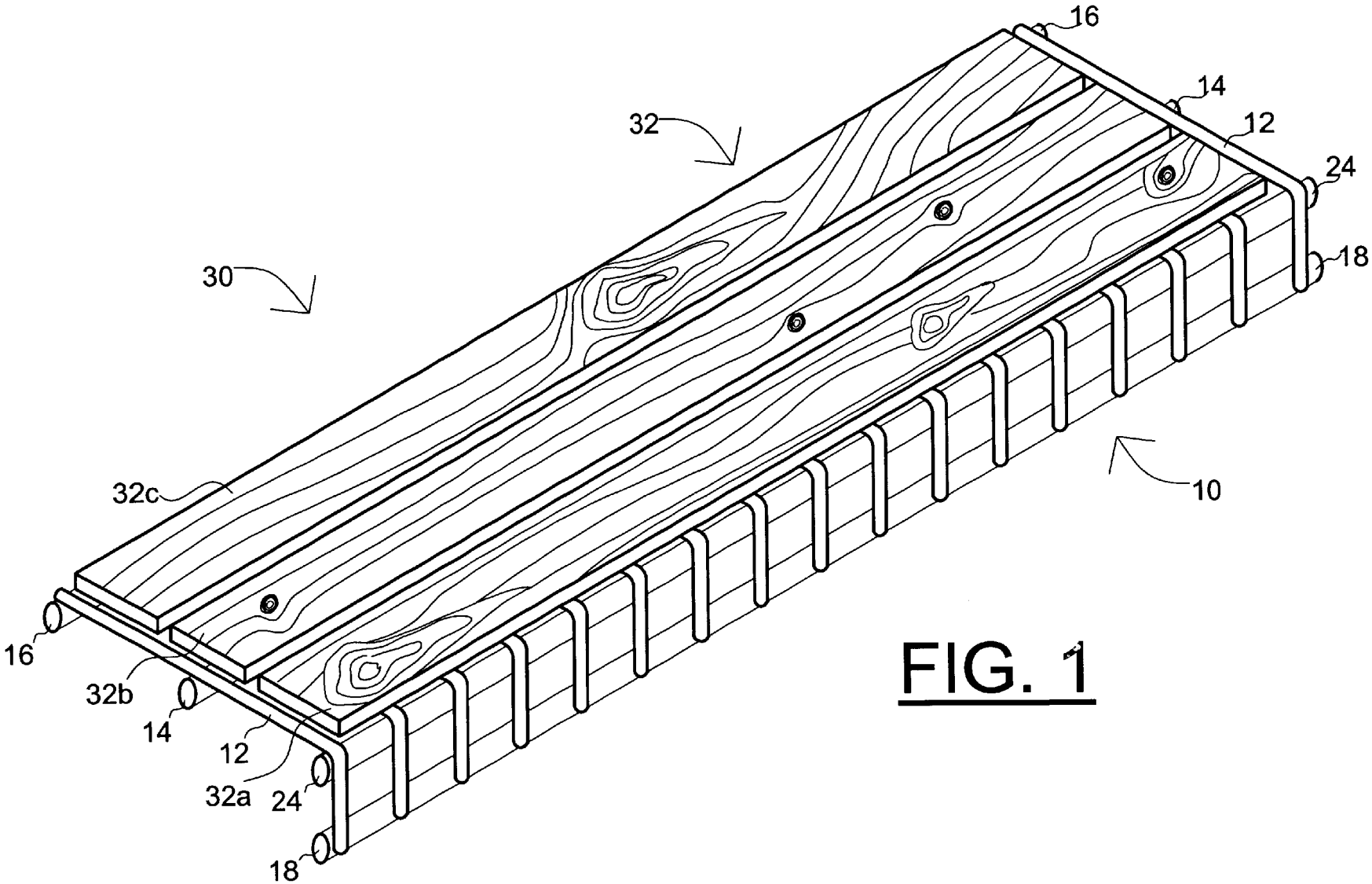
FIG. 1 is a perspective view illustration of an embodiment of the present invention used with a wire rack.

In describing the preferred embodiment of the invention which is illustrated in the drawings, specific terminology is resorted to for the sake of clarity. However, it is not intended that the invention be limited to the specific terms so selected and it is to be understood that each specific term includes all technical equivalents that operate in a similar manner to accomplish a similar purpose.

Although a preferred embodiment of the invention has been herein described, it is understood that various changes and modifications in the illustrated and described structure can be affected without departure from the basic principles that underlie the invention. Changes and modifications of this type are therefore deemed to be circumscribed by the spirit and scope of the invention, except as the same may be necessarily modified by the appended claims or reasonable equivalents thereof.

DETAILED DESCRIPTION OF THE INVENTION AND BEST MODE FOR CARRYING OUT THE PREFERRED EMBODIMENT

With reference to FIGS. 1–10, the shelving unit of the present invention is designated generally by the numeral 30. The wire rack with which it is configured to be used is designated by the numeral 10. As shown in the side view of FIG. 6, a simple wire rack 10" has a rear support rod 16 and a front support rod 24 joined by a plurality of coplanar transverse cross wires 12 to form a horizontal plane. The plurality of support wires can be seen in FIGS. 1 and 2. Various modifications to this basic design are made by different manufacturers to reinforce cross wires 12 and/or provide for attaching points for mounting hardware or for-hanging clothing by means of cloths hangers.

Figure 2:
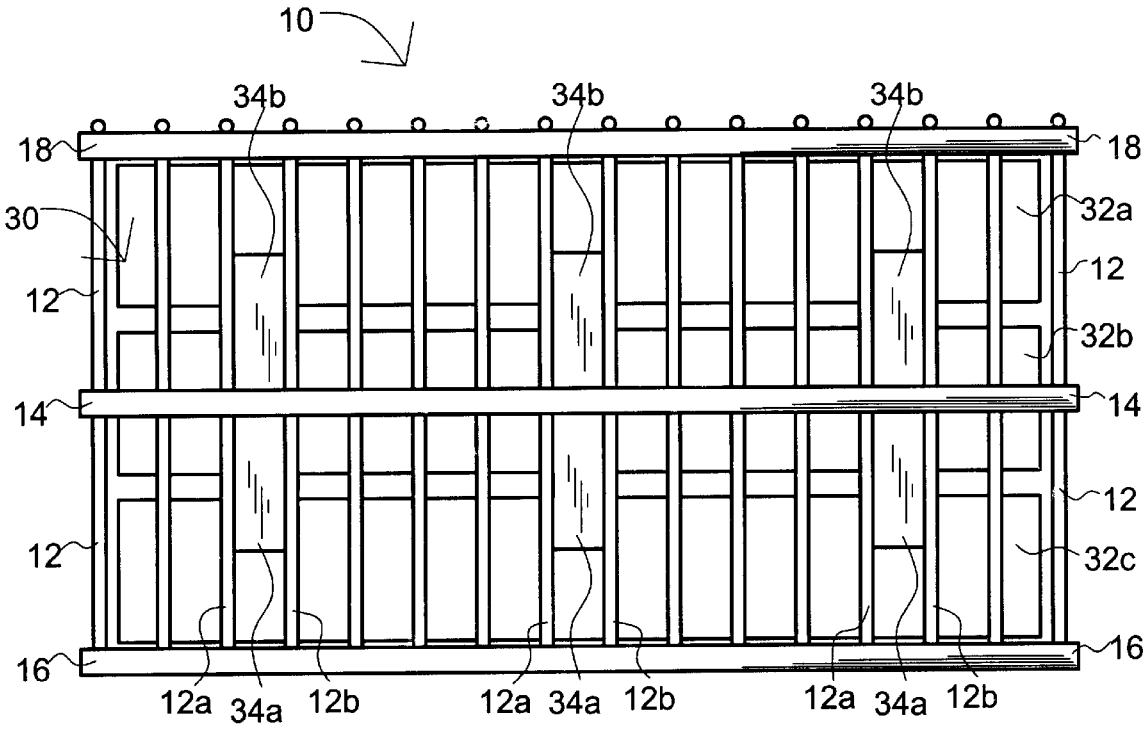
FIG. 2 is a bottom view of the embodiment of the present invention shown in FIG. 1.
Figure 4:
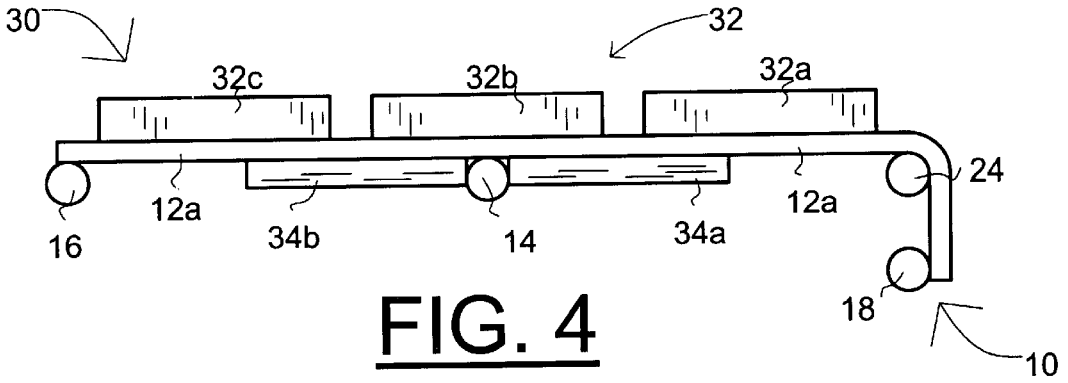
FIG. 4 is a side elevational view of the embodiment of the present invention shown in FIG. 1 as used with the wire rack shown in FIG. 1.
Figure 5:
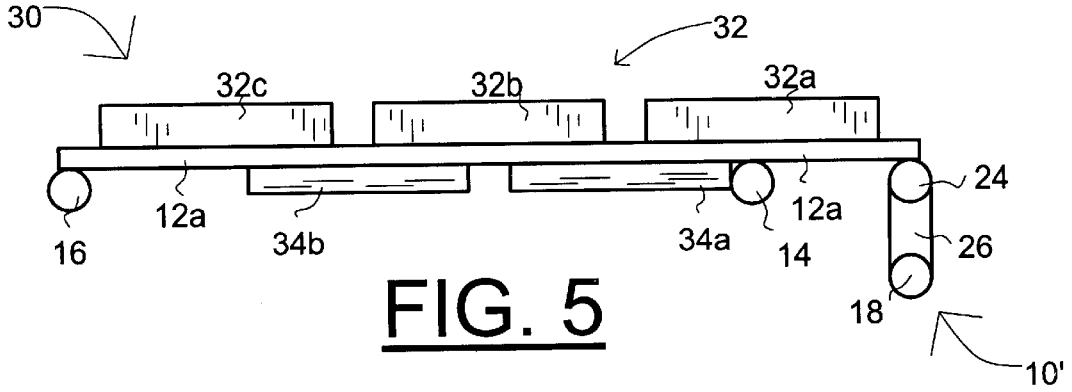
FIG. 5 is a side elevational view of the embodiment of the present invention shown in FIG. 1 as used with an alternate form of wire rack in which the central support rod is shifted toward the front of the wire rack.

In the wire rack shown in FIGS. 1,2, and 4, the transverse cross wires 12 are bent downward around rod 24 to join a lower rod 18. In FIG. 5, the lower and upper rods 18, 24 are joined by post 26. In wire rack 10" of FIG. 6, the lower rod has been omitted completely.

Figure 6:
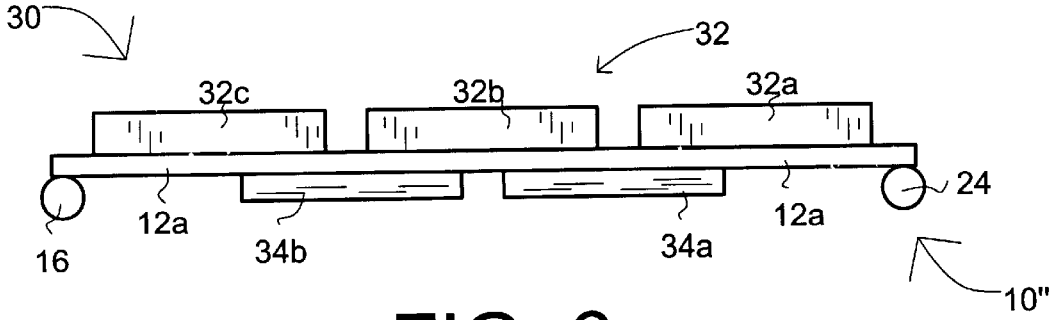
FIG. 6 is a elevational view of the embodiment of the present invention shown in FIG. 1 as used with a second alternate form of wire rack in which the central support rod is not used.

Depending on the manufacturer, the horizontal cross wires 12 may be further supported by an additional central support rod 14. As shown in FIGS. 1, 2, and 4, one manufacturer places a cental rod 14 in the middle of the configuration, that is, halfway between rear and front support rods 16 and 24. As seen in FIG. 5, another manufacturer places the central support rod 14 toward the front support rod 24. In FIG. 6, no central support rod 14 is used at all. One of the features of the present invention is to provide a single shelving unit 30 that fits these various wire rack configurations and provides a stable, non-moveable unit.

Figure 7:
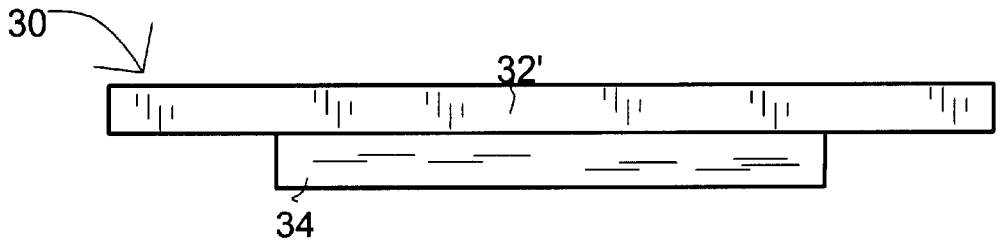
FIG. 7 is a side elevational view of a second embodiment of the present invention illustrating the use of a single elongated shelf member and a cleat.

In its basic form shown in FIG. 7, the shelving unit 30 of the present invetnion comprises a substantially flat elongated shelf member 32 (projecting or extending into the page) that has a transverse cleat 34 attached to its underside. As seen in FIGS. 2 and 4–6, the cleat 34 projects downward and passes between a pair of two adjacent support wires 12*a* and 12*b* (FIG. 2) until the shelf member 32 comes to rest on top of the support wires 12.

Figure 3:
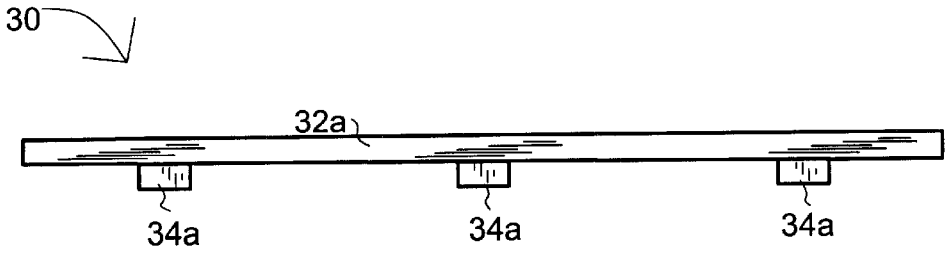
FIG. 3 is a front elevational view of the embodiment of the present invention shown in FIG. 1 without the wire rack.

Preferably cleat 34 is wide enough to contact and frictionally engage support wires 12*a* and 12*b* on its opposite sides. Proximity of both sides of the cleat minimizes or in the case of contact with both members of the wire member pair 12*a*, 12*b* eliminates sideways lateral movement of the elongated member 32 with respect to the rack device 10. Frictional engagement of the cleat 34 with pairs of adjacent support wires 12*a* and 12*b* also prevents forward and back motion of the shelf unit 30 with respect to wire rack 10. Finally the fact that the cleat has a lengthwise dimension that is in contact with the pairs of adjacent support wires 12*a* and 12*b* prevents rotational (twisting) motion of the shelf unit 30 with respect to the wire rack. Such twisting motion is further eliminated when several cleat members 34 are used in spaced apart relation along the length of shelf member 32 as shown in FIGS. 2 and 3.

As shown in FIGS. 4 and 5, cleat 34 is sized and positioned to accommodate a central rod 14 located in different positions by different manufacturers. As seen in FIG. 5, cleat 34 is of a length and position to contact central rod 14 and prevent forward motion of shelf member 32. As shown in FIG. 4, cleat 34 can be formed as two cleat sections 34*a* and 34*b* that are spaced apart to accommodate a central support rod 14 located in the center of wire rack 10. Here it is not possible for shelf member 32 to move in either a forward or backward direction.

As pointed out above, the present invention relies primarily on the frictional contact of the sides of the cleats 34 with pairs of support wires 12 to prevent forward and rearward movement. In addition, sizing and positioning of the cleats 34 and their component members allows the present invention to take advantage of the central or front support rods 14 or 24 to act as stops in preventing the shelf member 32 from sliding forward off of the wire rack 10.

The cleats 34 serve to maintain the spatial orientation of slats (either spaced apart or in contacting relation) of the elongated member 32 when such are used and also secure the elongated member 32 to the wire rack 10 by extending downward and frictionally engaging support wires 12 of the rack 10 thereby preventing lateral movement and also preventing forward, backward, and rotational movement of shelf member 32. Through appropriate sizing and positioning, cleats 34 engage differently positioned support rods in a variety of rack designs to prevent shelf member 32 from sliding off of the wire rack 10.

As shown in FIGS. 1–10, a wide variety of arrangements of flat elongated shelf members 32 and cleats 34 are contemplated by the present invention. FIGS. 1–6 illustrate three slats 32*a*, 32*b*, and 32*c* held in spaced apart relation by three cleats 34 (FIGS. 2 and 3) each comprised of cleat sections 34*a* and 34*b*. FIG. 7 illustrates a single shelf member 32' with a single transverse cleat 34, it being realized that it is preferable to used several spaced-apart cleats along the length of shelf member 32 to compound the frictional forces holding the shelving unit 30 to the wire rack 10 and decrease any twisting motion of shelving unit 30.

Figure 8:
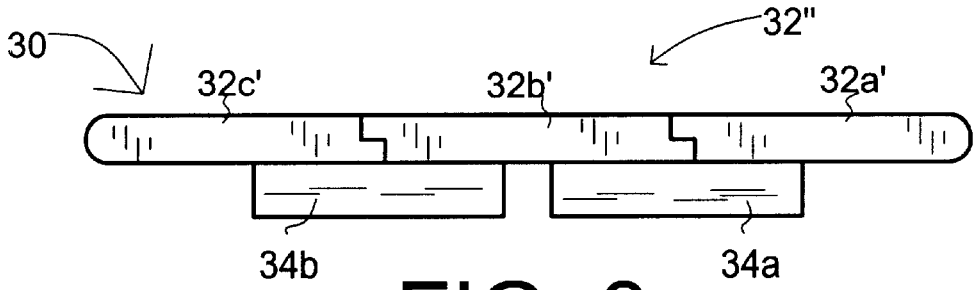
FIG. 8 is a side elevational view of a third embodiment of the present invention illustrating the use of an elongated shelf member formed from slats using a lap joint arrangement and two cleat sections.
Figure 9:
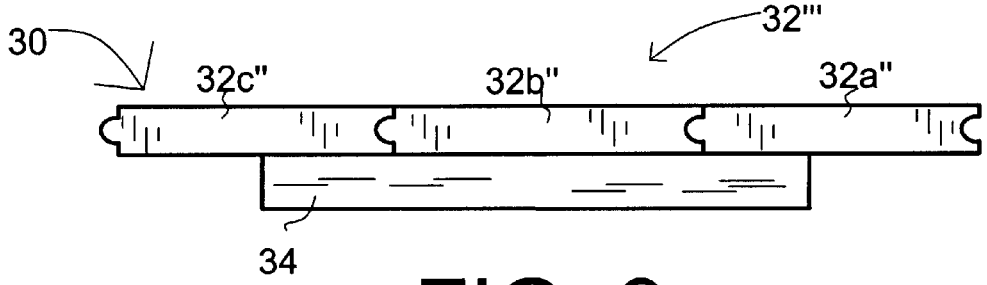
FIG. 9 is a side elevational view of a fourth embodiment of the present invention illustrating the use of a single elongated shelf member formed from slats using a tongue and grove joint arrangement and two cleat sections.
Figure 10:
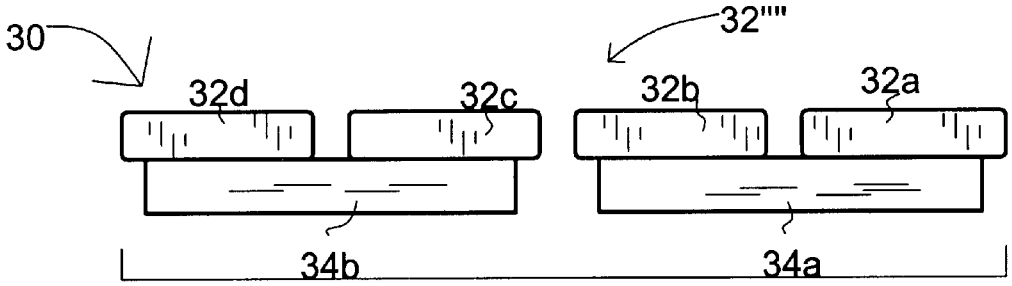
FIG. 10 is a side elevational view of a fifth embodiment of the present invention illustrating the use of an elongated shelf member composed of two separate sections with each section being joined by a cleat section.

FIG. 8 illustrates an elongated shelf member 32" formed from three interlocking ship-lap configured slats 32*a*', 32*b*', and 32*c*' held in position by transversely attached cleat sections 34*a* and 34*b*, while FIG. 8 illustrates a similar configuration with slats 32*a*", 32*b*", and 32*c*" held together in a tongue and groove configuration with cleat 34. As shown in FIG. 10, the elongated shelf member 32"" can be formed as two separate units. The first unit is composed of slats 32*a* and 32*b* held in spaced apart relation by cleat section 34*a* while the second unit is composed of slats 32*c* and 32*d* held in spaced-apart relation by cleat section 34*b*.

The elongated shelf member 32 and cleat 34 can be formed from a wide variety of materials including, but not limited to, wood, plywood, corrugated board, particle board, laminates, veneers, plastic lumber, plastic, and metal. The shelf member 32 and cleat 34 may be impregnated with compositions that afford air, clothing and linen freshening aroma and/or insect repelling characteristics. Preferably both air, clothing, and linen freshening and insect repelling capabilities are provided through the use of aromatic cedar wood to form at least some of the components of the shelf member 32 and/or cleat 34. Although the cleats 34 are attached to the elongated shelf member with suitable fasteners including staples, nails, screws, adhesives, and combinations thereof, it is to be realized that the cleats 34 and elongated shelf member 32 can be molded or otherwise formed as a single unit such as by molding, stamping, or pressing.

It is possible that changes in configurations to other than those shown could be used but that which is shown is preferred and typical. Without departing from the spirit of this invention, a wide variety of shelf members, shelf-member components, cleats, and cleat sections along with various means of fastening these components together may be used. It is therefore understood that although the present invention has been specifically disclosed with the preferred embodiments and examples, modifications to the design concerning sizing, shape, and alternative combinations will be apparent to those skilled in the art and such modifications and variations are considered to be equivalent to and within the scope of the disclosed invention and the appended claims.

I claim:

1. A shelf unit and wire rack assembly comprising:

a) a wire rack having:

1) at least two adjacent, parallel, spaced-apart support rods and 2) a plurality of parallel, spaced-apart, support wires fastened at right angles to said support rods; and b) a shelf unit having:

1) a substantially flat elongated member with an upper surface and a lower surface; and at least two, spaced apart cleats attached transverse to a length of said elongated member, each of said cleats being of a size to allow said cleats to fit between said adjacent support rods, frictionally engage, and extend downward between pairs of said parallel, spaced-apart support wires when aligned between said pair of support wires and pressed downward to urge said spaced-apart cleats between said pair of support wires to bring said elongated flat member in a resting position on said support wires such that said cleats are frictionally held between said support wires.

2. The shelf unit and wire rack assembly according to claim 1 wherein said cleats are formed in at least two, spaced apart sections with a distance between said spaced apart sections sufficiently great to accommodate a diameter of a central support rod located between said spaced apart support rods of said wire rack.

3. The shelf unit and wire rack assembly according to claim 2 wherein said substantially flat elongated member is formed from at least two spaced apart slats held in spaced-apart position by said cleat sections.

4. The shelf unit and wire rack assembly according to claim 3 wherein at least a portion of said slats and said cleat sections comprise cedar wood.

* * * * *